US010961481B2

(12) United States Patent
Zhang

(10) Patent No.: US 10,961,481 B2
(45) Date of Patent: Mar. 30, 2021

(54) THIOL-CARBOXYLIC ADDUCTS AS LUBRICATING ADDITIVES

(71) Applicant: The Lubrizol Corporation, Wickliffe, OH (US)

(72) Inventor: Yanshi Zhang, Solon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 15/614,657

(22) Filed: Jun. 6, 2017

(65) Prior Publication Data

US 2017/0349852 A1 Dec. 7, 2017

Related U.S. Application Data

(60) Provisional application No. 62/346,050, filed on Jun. 6, 2016.

(51) Int. Cl.

| | |
|---|---|
| ***C10M 173/02*** | (2006.01) |
| ***C10M 159/06*** | (2006.01) |
| ***C10M 135/00*** | (2006.01) |
| ***C10M 135/26*** | (2006.01) |
| ***C10M 169/04*** | (2006.01) |
| ***C10M 141/08*** | (2006.01) |
| ***C10M 141/10*** | (2006.01) |
| ***C10M 137/00*** | (2006.01) |
| *C10N 30/10* | (2006.01) |
| *C10N 30/12* | (2006.01) |
| *C10N 40/25* | (2006.01) |

(52) U.S. Cl.

CPC ..... *C10M 135/26* (2013.01); *C10M 137/00* (2013.01); *C10M 141/08* (2013.01); *C10M 141/10* (2013.01); *C10M 169/04* (2013.01); *C10M 2203/1025* (2013.01); *C10M 2207/026* (2013.01); *C10M 2207/289* (2013.01); *C10M 2215/064* (2013.01); *C10M 2215/28* (2013.01); *C10M 2219/022* (2013.01); *C10M 2219/024* (2013.01); *C10M 2219/046* (2013.01); *C10M 2219/06* (2013.01); *C10M 2219/085* (2013.01); *C10M 2219/089* (2013.01); *C10M 2223/00* (2013.01); *C10M 2223/045* (2013.01); *C10N 2030/10* (2013.01); *C10N 2030/12* (2013.01); *C10N 2040/25* (2013.01)

(58) Field of Classification Search

CPC ..... C10M 135/22; C10M 129/28; C10M 135/26; C10M 169/04; C10M 141/08; C10M 141/10; C10M 137/00; C10M 2219/06; C10M 2215/064; C10M 2219/024; C10M 2219/089; C10M 2203/1025; C10M 2223/00; C10N 2030/10; C10N 2030/12

USPC ..... 508/156, 312, 567

See application file for complete search history.

(56) References Cited

U.S. PATENT DOCUMENTS

| | | | | |
|---|---|---|---|---|
| 2,321,575 | A | 6/1943 | Clayton et al. | |
| 4,157,971 | A * | 6/1979 | Yaffe | C10M 169/04 508/439 |
| 4,189,388 | A | 2/1980 | Reinhard et al. | |
| 5,714,441 | A * | 2/1998 | Berlowitz | C10M 169/04 508/258 |
| 2006/0019838 | A1* | 1/2006 | Muir | C10L 1/303 508/198 |
| 2014/0342956 | A1 | 11/2014 | Hanyuda et al. | |
| 2015/0275129 | A1* | 10/2015 | Patil | C10M 105/72 508/516 |

OTHER PUBLICATIONS

"Use of Alkylthio-carboxylic Acid Esters As Synthetic Lubricants", Research Disclosure, Kenneth Mason Publications, Hampshire, UK, GB, vol. 411, No. 40, Jul. 1, 1998.

* cited by examiner

*Primary Examiner* — Prem C Singh
*Assistant Examiner* — Francis C Campanell
(74) *Attorney, Agent, or Firm* — Iken Sans; Teresan Gilbert; Teresan W. Gilbert

(57) ABSTRACT

Lubricating compositions comprising a thiol-carboxylic adduct that is the reaction product of a thiol and carboxylic acid and/or a carboxylic acid derivative. The lubricating composition also comprises an antiwear agent. Methods of lubricating an internal combustion engine comprise contacting the internal combustion engine with a lubricating composition comprising a thiol-carboxylic adduct that is the reaction product of a thiol and carboxylic acid and/or a carboxylic acid derivative. Methods of reducing lubricant oxidation and/or corrosion in an internal combustion engine with a lubricating composition comprising a thiol-carboxylic adduct that is the reaction product of a thiol and carboxylic acid and/or a carboxylic acid derivative. The use of a comprising a thiol-carboxylic adduct that is the reaction product of a thiol and carboxylic acid and/or a carboxylic acid derivative to reduce lubricant oxidation and/or corrosion in an internal combustion engine.

19 Claims, No Drawings

THIOL-CARBOXYLIC ADDUCTS AS LUBRICATING ADDITIVES

FIELD OF THE INVENTION

The field of the disclosed technology is generally related to lubricating compositions comprising thiol-carboxylic adducts.

BACKGROUND OF THE INVENTION

It is well known for lubricating oils to contain a number of additives. These additives can be classified as "chemically active" or "chemically inert". Chemically active additives interact chemically with metal surfaces equipment components and internal combustions engines to protect them from wear, soot deposits and acid build up. Chemically active additives can include, for example, antiwear agents, dispersants, detergents, or corrosion inhibitors. Chemically inert additives do not interact chemically with metal surfaces, but rather improve the physical properties of the lubricant. Chemically inert additives can include total base number ("TBN") boosters that prevent the lubricant from becoming too acidic as it becomes contaminated with acidic combustion products. Antioxidants are also an important class of chemically inert additives because they prevent oxidative and thermal decomposition of the lubricant.

Many additives, while beneficial in one area, can have detrimental side effects other areas or can negatively impact the effectiveness of other additives present in the lubricant. For example, surface active antiwear additives comprising zinc dialkyldithiophosphates (ZDDP). ZDDP, while reducing wear in a combustion engine, can have harmful effects on lead or copper present in bearings and other metal engine components derived from alloys using copper or lead.

Another example are antioxidants containing sulfur. When used in lubricants for lubricating lead metals or alloys, the sulfur-containing antioxidants can cause corrosion of the lead. The sulfur can form lead sulfides on the metal surfaces. These lead sulfides are brittle and can flake off resulting in the corrosion of the metal surfaces and particulate contamination of the lubricant. This makes it difficult for formulators to meet the present engine oil specifications by employing certain beneficial additives while also meeting the specification for lead corrosion.

SUMMARY OF THE INVENTION

It was surprisingly determined, however, that thiol-carboxylic adducts are surprisingly effective at reducing oxidation of the lubricant and reducing lead corrosion, even in the presence of antiwear additives comprising ZDDP. Accordingly, in one embodiment, lubricating compositions comprising a thiol-carboxylic adduct (antioxidant) that is the reaction product of a thiol and carboxylic acid and/or a carboxylic acid derivative are disclosed. The hydroxyl group of the carboxylic acid or carboxylic acid derivative is substituted with a $C_1$-$C_{20}$ hydrocarbyl group. The lubricating composition also comprises an antiwear agent.

In some embodiments, the carboxylic acid or carboxylic acid derivative may be an acrylic. The acrylic may comprise at least one (meth)acrylate, (meth)acrylic acid, (meth)acrylamide, or combinations thereof. As used herein, the term "acrylic" includes derivatives of acrylic or methacrylic acids, salts, esters or amides. Further, the term "(meth) acrylate" and related terms includes both acrylate and methacrylate groups, i.e. the methyl group is optional. Accordingly, in some embodiments, the acrylic may comprise at least one acrylate, acrylic acid, acrylamide, methacrylate, methacrylic acid, methacrylamide, or combinations thereof. In one embodiment, the acrylic may comprise dimethyl acrylamide.

In yet other embodiments, the acrylic may be a (meth) acrylate having the formula (I):

(I)

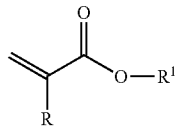

wherein R is a hydrogen or a $C_1$-$C_{20}$ hydrocarbyl group and $R^1$ is a $C_1$-$C_{20}$ hydrocarbyl group. In another embodiment, R may be a hydrogen or a methyl group.

In one embodiment, the (meth)acrylate may comprise at least one acrylate, methacrylate, or combinations thereof. Suitable acrylates include, but are not limited to, octadecyl acrylate, hexadecyl acrylate, tridecyl acrylate, dodecyl acrylate, decyl acrylate, 2-propylheptyl acrylate, 2-ethylhexyl acrylate, octyl acrylate, hexyl acrylate, butyl acrylate, ethyl acrylate, methyl acrylate, or combinations thereof. Suitable methacrylates include, but are not limited to, octadecyl methacrylate, hexadecyl methacrylate, tridecyl methacrylate, dodecyl methacrylate, decyl methacrylate, 2-propylheptyl methacrylate, 2-ethylhexyl methacrylate, octyl methacrylate, hexyl methacrylate, butyl methacrylate, ethyl methacrylate, methyl methacrylate, or combinations thereof.

The thiol may be aliphatic, cyclic, or acyclic. In another embodiment, the thiol may comprise at least one of methanethiol, ethanethiol, 1-propanethiol, 2-propanethiol, butanethiol, tert-butyl mercaptan, pentanethiol, hexanethiol, octanethiol, decanethiol, 1-dodecanethiol, 2-dodecanethiol, hexadecanethiol, or combinations thereof.

In some embodiments, the lubricating composition may comprise thiol-carboxylic adducts having the formula (II):

(II)

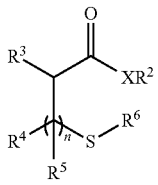

wherein $R^2$ is a hydrogen or a $C_1$-$C_{20}$ hydrocarbyl group; $R^3$, $R^4$, and $R^5$ individually are hydrogen or a $C_1$-$C_{12}$ hydrocarbyl group, $R^6$ is a $C_1$-$C_{20}$ hydrocarbyl group; X is O or N; and n is 0 or 1.

The lubricating composition may have an antiwear agent. In one embodiment, the antiwear agent may comprise phosphorus and is present in an amount such that the lubricating composition has at least 300 ppm phosphorus based on a total weight of the lubricating composition.

In other embodiments, the lubricating composition may comprise additives in addition to the thiol-carboxylic adduct and antiwear agent described above. Accordingly, in another embodiment, the lubricating composition may further comprise a nitrogen-containing dispersant. In another embodiment, the lubricating composition may comprise at least one boron-containing compound. Exemplary boron-containing compounds include, but are not limited to, borate esters, borate alcohols, or combinations thereof. In yet another embodiments, the lubricating composition may comprise at least one overbased detergent.

Other lubricating compositions may comprise a second antioxidant in addition to the thiol-carboxylic adduct described above. In one embodiment, the second antioxidant may comprise at least one of a phenolic antioxidant, aminic antioxidant, or combinations thereof.

In another embodiment, the lubricating compositions described above may comprise from 0.01 wt % to 5 wt % of a thiol-carboxylic adduct based on a total weight of the lubricating composition.

Methods of lubricating an internal combustion engine are also disclosed. In one embodiment, the method may comprise contacting the internal combustion engine with a lubricating composition as described above. The lubricating composition may comprise a thiol-carboxylic adduct formed by reacting a thiol with a carboxylic acid and/or a carboxylic acid derivative. The lubricating composition also comprises an antiwear agent.

In yet other embodiments, methods of reducing lubricant oxidation and/or corrosion in an internal combustion engine are disclosed. The methods may comprise contacting the internal combustion engine with the lubricating compositions described above. In another embodiment, the use of a thiol-carboxylic adduct in a lubricating composition to reduce lubricant oxidation and/or corrosion in an internal combustion engine is disclosed.

DETAILED DESCRIPTION OF THE INVENTION

Each of the documents referred to herein is incorporated by reference, including any prior applications, whether or not specifically listed herein, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

Various features and embodiments will be described below by way of non-limiting descriptions and examples. In one embodiment, lubricating compositions comprising a thiol-carboxylic adduct that is the reaction product of a thiol and carboxylic acid and/or a carboxylic acid derivative are disclosed. The hydroxyl group of the carboxylic acid or carboxylic acid derivative is substituted with a $C_1$-$C_{20}$ hydrocarbyl group. The lubricating composition may also comprise an antiwear agent.

In some embodiments, the carboxylic acid or carboxylic acid derivative may be an acrylic. The acrylic may comprise at least one (meth)acrylate, (meth)acrylic acid, (meth)acrylamide, or combinations thereof.

In yet other embodiments, the acrylic may be a (meth) acrylate having the formula (I):

(I)

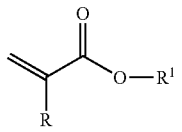

wherein R is a hydrogen or a $C_1$-$C_{20}$ hydrocarbyl group and $R^1$ is a $C_1$-$C_{20}$ hydrocarbyl group. In another embodiment, R may be a hydrogen or a methyl group.

As used herein, the terms "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. The hydrocarbyl sub stituent or hydrocarbyl group may have more than one carbon atom. The number of carbon atoms may also be indicated herein. For example, the term "$C_1$-$C_{20}$ hydrocarbyl group" means a hydrocarbyl group having 1 to 20 carbon atoms. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of the disclosed technology, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of the disclosed technology, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

In other embodiments, the acrylic may comprise an acrylic acid having the formula (III):

(III)

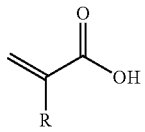

wherein R is a hydrogen or a $C_1$-$C_{20}$ hydrocarbyl group.

In yet other embodiments, the acrylic may comprise an acrylamide having the formula (IV):

(IV)

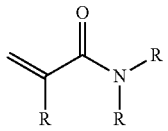

wherein each R may independently be a hydrogen or a $C_1$-$C_{20}$ hydrocarbyl group.

In one embodiment, the acrylic may comprise at least one methacrylate, methacrylic acid, methacrylamide, or combinations thereof. In another embodiment, the (meth)acrylate may comprise at least one acrylate, methacrylate, butylacrylate, or combinations thereof. In yet another embodiment, the (meth)acrylate may comprise at least one acrylate, methacrylate, or combinations thereof. In other embodiments, the acrylic may comprise at least one acrylate, acrylic acid, acrylamide, methacrylate, methacrylic acid, methacrylamide, or combinations thereof. In one embodiment, the acrylic may comprise dimethyl acrylamide.

Suitable acrylates include, but are not limited to, octadecyl acrylate, hexadecyl acrylate, tridecyl acrylate, dodecyl acrylate, decyl acrylate, 2-propylheptyl acrylate, 2-ethylhexyl acrylate, octyl acrylate, hexyl acrylate, butyl acrylate, ethyl acrylate, methyl acrylate, or combinations thereof. Suitable methacrylates include, but are not limited to, octadecyl methacrylate, hexadecyl methacrylate, tridecyl methacrylate, dodecyl methacrylate, decyl methacrylate, 2-propylheptyl methacrylate, 2-ethylhexyl methacrylate, octyl methacrylate, hexyl methacrylate, butyl methacrylate, ethyl methacrylate, methyl methacrylate, or combinations thereof.

The thiol may be aliphatic, cyclic, or acyclic. In another embodiment, the thiol may comprise at least one of methanethiol, ethanethiol, 1-propanethiol, 2-propanethiol, butanethiol, tert-butyl mercaptan, pentanethiol, hexanethiol, octanethiol, decanethiol, 1-dodecanethiol, 2-dodecanethiol, hexadecanethiol, or combinations thereof.

In some embodiments, the lubricating composition may comprise thiol-carboxylic adducts having the formula (II):

(II)

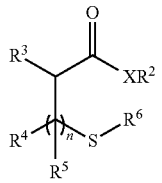

wherein $R^2$ is a hydrogen or a $C_1$-$C_{20}$ hydrocarbyl group; $R^3$, $R^4$, and $R^5$ individually are hydrogen or a $C_1$-$C_{12}$ hydrocarbyl group, $R^6$ is a $C_1$-$C_{20}$ hydrocarbyl group; X is O or N; and n is 0 or 1.

When n is 0, the thiol-carboxylic adducts may have the formula (V):

(V)

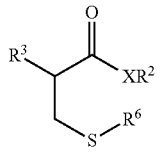

wherein $R^2$ is a hydrogen or a $C_1$-$C_{20}$ hydrocarbyl group; $R^3$ is hydrogen or a $C_1$-$C_{12}$ hydrocarbyl group, $R^6$ is a $C_1$-$C_{20}$ hydrocarbyl group; and X is O or N. Exemplary thiol-carboxylic adducts having formula (III) include, but are not limited to, 3-(ethylthio)-N,N-dimethylpropanamide, methyl 3-(ethylthio)propanoate, 2-ethylhexyl 3-(ethylthio)propanoate, dodecyl 3-(ethylthio)propanoate, or mixtures thereof.

Oils of Lubricating Viscosity

The lubricating compositions comprising a thiol-carboxylic adduct described herein may also comprise an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerized Fischer-Tropsch hydrocarbons or waxes. In one embodiment, oils may be prepared by a Fischer-Tropsch gas-to-liquid synthetic procedure as well as other gas-to-liquid oils.

Oils of lubricating viscosity may also be defined as specified in the September 2011 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. In one embodiment, the oil of lubricating viscosity may be an API Group I oil.

The amount of the oil of lubricating viscosity present is typically the balance remaining after subtracting from 100 wt % the sum of the amount of the compound of the invention and the other performance additives. The amount of each chemical component or additive described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

The lubricating composition may have an antiwear agent. The antiwear agent may be a phosphorus-containing or a sulfur-containing antiwear agent. In one embodiment, the antiwear agent may comprise phosphorous that is present in an amount such that the lubricating composition has at least 300 ppm phosphorous based on a total weight of the lubricating composition. In other embodiments, the phosphorous content may be 300 to 1000 ppm or 325 to 700 ppm phosphorous based on a total weight of the lubricating composition.

In another embodiment, the lubricating composition may further comprise a nitrogen-containing dispersant. In another embodiment, the lubricating composition may comprise at least one boron-containing compound. Exemplary boron-containing compounds include, but are not limited to, borate esters, borate alcohols, or combinations thereof. In yet another embodiment, the lubricating composition may comprise at least one overbased detergent.

Other lubricating compositions may comprise a second antioxidant in addition to the thiol-carboxylic adduct described above. In one embodiment, the second antioxidant may comprise at least one of a phenolic antioxidant, aminic antioxidant, or combinations thereof.

The lubricating compositions may comprise from 0.01 wt % to 5 wt % of a thiol-carboxylic adduct based on a total weight of the lubricating composition.

Methods of lubricating an internal combustion engine are also disclosed. In one embodiment, the method may comprise contacting the internal combustion engine with a lubricating composition as described above. The lubricating composition may comprise a thiol-carboxylic adduct formed by reacting a thiol with a carboxylic acid and/or a carboxylic acid derivative. The lubricating composition also comprises an antiwear agent.

In yet other embodiments, methods of reducing lubricant oxidation and/or corrosion in an internal combustion engine are disclosed. The methods may comprise contacting the internal combustion engine with the lubricating compositions described above. In another embodiment, the use of a thiol-carboxylic adduct in a lubricating composition to reduce lubricant oxidation and/or corrosion in an internal combustion engine is disclosed.

Antiwear Agents

The disclosed lubricating compositions may comprise a phosphorus-containing or a sulfur-containing antiwear agent. These antiwear agents may be corrosive, particularly to metals such as lead or copper, under some conditions. The thiol-carboxylic adducts described herein, however, can reduce the corrosive effects of the antiwear agents without affecting their efficacy in reducing wear. Accordingly, in some embodiments methods of reducing corrosion in an engine comprise contacting the engine with a lubricant composition having the thiol-carboxylic adduct therein as described above. In yet other embodiments, lead corrosion is reduced.

Accordingly, in other embodiments, the disclosed technology provides a lubricating composition which further includes a phosphorus-containing and/or a sulfur-containing antiwear agent. Typically, the phosphorus-containing antiwear agent may be zinc dialkyldithiophosphates, phosphites, phosphates, phosphonates, and ammonium phosphate salts or mixtures thereof.

Zinc dialkyldithiophosphates are known in the art. Examples of zinc dithiophosphates include zinc isopropyl methylamyl dithiophosphate, zinc isopropyl isooctyl dithiophosphate, zinc di(cyclohexyl) dithiophosphate, zinc isobutyl 2-ethylhexyl dithiophosphate, zinc isopropyl 2-ethylhexyl dithiophosphate, zinc isobutyl isoamyl dithiophosphate, zinc isopropyl n-butyl dithiophosphate, and combinations thereof. Zinc dialkyldithiophosphate may be present in an amount to provide 0.01 wt % to 0.1 wt % phosphorus to the lubricating composition, or to provide 0.015 wt % to 0.075 wt % phosphorus, or 0.02 wt % to 0.05 wt % phosphorus to the lubricating composition.

In another embodiment, the lubricant composition further comprises one or more zinc dialkyldithiophosphates such it provides at least 50% of the total phosphorus present in the lubricating composition, or at least 70% of the total phosphorus, or at least 90% of the total phosphorus in the lubricating composition. In one embodiment, the lubricant composition is free or substantially free of a zinc dialkyldithiophosphate.

The sulfur-containing antiwear agent may be sulfurized olefins, sulfur-containing detergents, or sulfurized Diels-Alder adducts. The antiwear agent may be present at 0.01 wt % to 3 wt %, or 0.1 wt % to 1.5 wt %, or 0.5 wt % to 0.9 wt % based on a total weight of the lubricating composition.

Antioxidants

In one embodiment the disclosed lubricant composition includes an antioxidant in addition to the thiol-carboxylic adducts disclosed herein, or mixtures thereof. The antioxidant may be present at 0.05 wt % to 15 wt %, or 0.1 wt % to 10 wt %, or 0.5 wt % to 5 wt %, or 0.5 wt % to 3 wt %, or 0.3 wt % to 1.5 wt % based on a total weight of the lubricant composition. Antioxidants include sulfurized olefins, diarylamines, alkylated diarylamines, hindered phenols, molybdenum compounds (such as molybdenum dithiocarbamates), hydroxyl thioethers, or mixtures thereof. In one embodiment the lubricant composition may comprise a phenolic or an aminic antioxidant or mixtures thereof, and wherein the antioxidant is present at 0.1 wt % to 3 wt %, or 0.5 wt % to 2.75 wt %, or 1 wt % to 2.5 wt % based on a total weight of the lubricant composition.

The diarylamine or alkylated diarylamine may be a phenyl-α-naphthylamine (PANA), an alkylated diphenylamine, or an alkylated phenylnaphthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnaphthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidant, include commercial materials sold under the trade names such as Molyvan 822®, Molyvan® A and Molyvan® 855 from R. T. Vanderbilt Co., Ltd., and Adeka Sakura-Lube™ S-100, S-165, S-600 and 525, or mixtures thereof.

Boron-Containing Compounds

In one embodiment, the lubricating compositions further include a boron-containing compound. In one embodiment the boron-containing compound includes a borate ester or a borate alcohol.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms, i.e., vicinal.

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment, suitable borate ester compounds include triethyl borate, tripropyl borate, triisopropyl borate, tributyl borate, tripentyl borate, trihexyl borate, tricyclohexyl borate, trioctyl borate, triisooctyl borate, tridecyl borate, tri ($C_{8-10}$) borate, tri ($C_{12-15}$ borate) and oleyl borate, or mixtures thereof.

In one embodiment, the boron-containing compound is a borated fatty acid ester of glycerol. The borated fatty acid esters of glycerol are prepared by borating a fatty acid ester of glycerol with boric acid with removal of the water of reaction. In one embodiment, there is sufficient boron present such that each boron will react with from 1.5 to 2.5 hydroxyl groups present in the reaction mixture.

The reaction may be carried out at a temperature in the range of 60° C. to 135° C., in the absence or presence of any suitable organic solvent such as methanol, benzene, xylenes, toluene, neutral oil and the like.

Fatty acid esters of glycerol can be prepared by a variety of methods well known in the art. Many of these esters, such as glycerol monooleate and glycerol tallowate, are manufactured on a commercial scale. The esters useful for this invention are oil-soluble and may be prepared from $C_8$ to $C_{22}$ fatty acids or mixtures thereof such as are found in natural products. The fatty acid may be saturated or unsaturated. Certain compounds found in acids from natural sources may include licanic acid which contains one keto group. In one embodiment, the $C_8$ to $C_{22}$ fatty acids are those of the formula $R^{10}$—COOH wherein $R^{10}$ is alkyl or alkenyl.

In one embodiment, the fatty acid ester of glycerol is a monoester of glycerol, however, mixtures of mono- and diesters may be used. The mixture of mono- and diester can contains at least 40% of the monoester. In one embodiment, mixtures of mono- and diesters of glycerol contain from 40 to 60 percent by weight of the monoester. For example, commercial glycerol monooleate contains a mixture of from 45% to 55% by weight monoester and from 55% to 45% diester.

In one embodiment, the fatty acids include oleic, stearic, isostearic, palmitic, myristic, palmitoleic, linoleic, lauric, linolenic, and eleostearic, and the acids from the natural products tallow, palm oil, olive oil, peanut oil, corn oil, neat's foot oil and the like. In one embodiment, the fatty acid is oleic acid.

The boron-containing compound may be employed in the inventive lubricating oil composition at a sufficient concentration to provide the lubricating oil composition with a boron level in the range of from 5 ppm to 2000 ppm, and in one embodiment 15 ppm to 600 ppm, and in one embodiment 20 ppm to 300 ppm.

Other Performance Additives

The composition optionally comprises other performance additives. The other performance additives may include at least one of metal deactivators, viscosity modifiers, detergents, friction modifiers, antiwear agents, corrosion inhibitors (other than the thiol-carboxylic adducts presently disclosed), dispersants, dispersant viscosity modifiers, extreme pressure agents, antioxidants (other than the thiol-carboxylic adducts presently disclosed), foam inhibitors, demulsifiers, pour point depressants, seal swelling agents and mixtures thereof. These other performance additives may be in addition to the additives of the disclosed technology. For example, additives may be corrosion inhibitors, antiwear agents and/or antioxidants present in the lubricating composition in addition to those described in other embodiments of the disclosed technology.

Accordingly, in one embodiment, the disclosed technology provides a lubricating composition further comprising at least one of a dispersant, an antiwear agent, a dispersant viscosity modifier, a friction modifier, a viscosity modifier (typically an olefin copolymer such as an ethylene-propylene copolymer), an antioxidant (as described above), an overbased detergent (including overbased sulfonates and phenates), an extreme pressure agent, a foam inhibitor, a demulsifier, a pour point depressant, a seal swelling agent, or mixtures thereof.

The dispersant may be a succinimide dispersant, or mixtures thereof. In one embodiment, the dispersant may be present as a single dispersant. In one embodiment, the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof.

In one embodiment, the aliphatic polyamine may be ethylenepolyamine. In one embodiment, the aliphatic polyamine may be selected from the group consisting of ethylenediamine, diethylenetriamine, tri ethylenetetramine, tetraethylenepentamine, pentaethylenehexamine, polyamine still bottoms, and mixtures thereof.

The dispersant may also be derived from a material having an aromatic amine. The aromatic amine that may be useful is disclosed in International publications WO2010/062842 and WO2009/064685 (a similar disclosure is provided in US 2010/298185). The aromatic amine of WO2009/064685 is typically reacted with isatoic anhydride.

The aromatic amine may typically not be a heterocycle. The aromatic amine may include aniline, nitroaniline, aminocarbazole, 4-aminodiphenylamine (ADPA), and coupling products of ADPA. In one embodiment, the amine may be 4-aminodiphenylamine (ADPA), or coupling products of ADPA. The aromatic amine may include bis[p-(p-aminoanilino)phenyl]-methane, 2-(7-amino-acridin-2-ylmethyl)-N-4-{4-[4-(4-amino-phenylamino)-b enzyl]-phenyl}-benzene-1,4-diamine, N-{4-[4-(4-amino-phenyl amino)-benzyl]-phenyl}-2-[4-(4-amino-phenylamino)-cyclohexa-1,5-dienylmethyl]benzene-1,4-di amine, N-[4-(7-amino-acridin-2-ylmethyl)-phenyl]-benzene-1,4-diamine, or mixtures thereof.

The dispersant may be an N-substituted long chain alkenyl succinimide. Examples of N-substituted long chain alkenyl succinimide include polyisobutylene succinimide. Typically, the polyisobutylene from which polyisobutylene succinic anhydride is derived has a number average molecular weight of 350 to 5000, or 550 to 3000 or 750 to 2500. Succinimide dispersants and their preparation are disclosed, for instance, in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersant may also be post-treated by conventional methods by a reaction with any of a variety of agents. Among these are boron compounds (such as boric acid & borate esters), urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds. The dispersant may be present at 0.1 wt % to 10 wt %, or 2.5 wt % to 6 wt %, or 3 wt % to 5 wt % of the lubricating composition.

In one embodiment, the lubricating composition of disclosed technology further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. More detailed descriptions of dispersant viscosity modifiers are disclosed in International Publication WO2006/015130 or U.S. Pat. Nos. 4,863,623; 6,107,257; 6,107,258; and 6,117,825. In one embodiment, the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment, the dispersant viscosity modifier may include those described in U.S. Pat. No. 7,790,661 column 2, line 48 to column 10, line 38. The dispersant viscosity modifier of U.S. Pat. No. 7,790,661 includes (a) a polymer comprising carboxylic acid functionality or a reactive equivalent thereof, said polymer having a number average molecular weight of greater than 5,000; and (b) an amine component comprising at least one aromatic amine containing at least one amino group capable of condensing with a carboxylic acid functionality to provide a pendant group and at least one additional group comprising at least one nitrogen, oxygen, or sulfur atom. The aromatic amine may be selected from the group consisting of (i) a nitro-substituted aniline, (ii) amines comprising two aromatic moieties linked by a —C(O)NR$^{11}$— group, a —C(O)O— group, an —O— group, an —N—N— group, or an —$SO_2$— group, wherein R$^{11}$ is hydrogen, hydrocarbyl, or one of an aromatic moiety bearing a condensable amino group, (iii) an aminoquinoline, (iv) an aminobenzimidazole, (v) an N,N-dialkylphenylenediamine, and (vi) a ring-substituted benzylamine.

In one embodiment, the disclosed technology can be a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm, 5 ppm to 300 ppm, or 20 ppm to 250 ppm of molybdenum.

In one embodiment, the disclosed technology can be a lubricating composition further comprising an overbased detergent. Overbased detergents are known in the art. The overbased detergent may be selected from the group consisting of non-sulfur containing phenates, sulfur containing phenates, sulfonates, salixarates, salicylates, and mixtures thereof.

The overbased detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

Typically an overbased detergent may be sodium, calcium or magnesium salt of the phenates, sulfur containing phenates, sulfonates, salixarates and salicylates. Overbased phenates and salicylates typically have a total base number of 180 to 450 TBN. Overbased sulfonates typically have a total base number of 250 to 600, or 300 to 500. In one embodiment, the sulfonate detergent may be a predominantly linear alkylbenzene sulfonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulfonate detergent may be particularly useful for assisting in improving fuel economy. In one embodiment, the sulfonate detergent may be a metal salt of one or more oil-soluble alkyl toluene sulfonate compounds as disclosed in paragraphs [0046] to [0053] of US Patent Application 2008/0119378. The overbased detergent may be present at 0 wt % to 15 wt %, or 1 wt % to 10 wt %, or 3 wt % to 8 wt %. For example, in a heavy duty diesel engine, the detergent may be present at or 3 wt % to 5 wt % of the lubricating composition. For a passenger car engine, the detergent may be present at 0.2 wt % to 1 wt % of the lubricating composition.

In one embodiment, the lubricating composition includes an antioxidant as described above in addition to the thiol-carboxylic adducts disclosed herein.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulfurized fatty compounds and olefins, molybdenum dialkyldithiophosphates, molybdenum dithiocarbamates, sunflower oil or monoester of a polyol and an aliphatic carboxylic acid.

In one embodiment, the friction modifier may comprise at least one of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition. In one embodiment, the lubricating composition may be free of long chain fatty esters (typically glycerol monooleate).

As used herein, the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the (β-position. Examples of mono branched alkyl groups include 2-ethylhexyl, 2-propylheptyl or 2-octyldodecyl.

In one embodiment, the friction modifier may comprise at least one of long chain fatty acid derivatives of amines, fatty esters, or fatty epoxides; fatty alkyl citrates, fatty alkyl tartrates; fatty alkyl tartrimides; and fatty alkyl tartramides.

In one embodiment, the friction modifier may be a long chain fatty acid ester. In another embodiment, the long chain fatty acid ester may be a mono-ester and in another embodiment the long chain fatty acid ester may be a triglyceride.

Other performance additives such as corrosion inhibitors include those described in paragraphs 5 to 8 of WO2006/047486, octyl octanamide, condensation products of dodecenyl succinic acid or anhydride and a fatty acid such as oleic acid with a polyamine. In one embodiment, the corrosion inhibitors include the Synalox® (a registered trademark of The Dow Chemical Company) corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles.

In one embodiment, the corrosion inhibitors and metal deactivators described above may be used in addition to the thiol-carboxylic adducts described herein. In yet another embodiment, the corrosion inhibitors and metal deactivators described above may be substituted with the thiol-carboxylic described herein.

Foam inhibitors include polysiloxane or copolymers of ethyl acrylate and 2-ethylhexyl acrylate and optionally vinyl acetate. Demulsifiers include trialkyl phosphates, polyethylene glycols, polyethylene oxides, polypropylene oxides and (ethylene oxide-propylene oxide) polymers. Pour point depressants include esters of maleic anhydride-styrene, polymethacrylates, polyacrylates or polyacrylamides.

In different embodiments, the lubricating composition may have a composition as described in Table 1. The weight percents (wt %) shown in Table 1 below are on an actives basis.

TABLE 1

| Additive | Embodiments (wt %) | | |
|---|---|---|---|
| | A | B | C |
| Thiol-Carboxylic adducts | 0.01 to 3 | 0.01 to 3 | 0.01 to 3 |
| Boron-Containing Compound | 0.0 to 8 | 0.05 to 4 | 0.05 to 3 |
| Nitrogen-Containing Dispersant | 0.05 to 12 | 0.5 to 8 | 1 to 5 |
| Dispersant Viscosity Modifier | 0 to 5 | 0 to 4 | 0.05 to 2 |
| Overbased Detergent | 0 to 15 | 0.1 to 8 | 0.5 to 3 |
| Antioxidant | 0 to 15 | 0.1 to 10 | 0.5 to 5 |
| Phosphorous Antiwear Agent | 0.1 to 15 | 0.2 to 6 | 0.3 to 2 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Industrial Application

The lubricating composition may be utilized in an internal combustion engine. The engine or engine components may be made of an alloy comprising lead or copper. In one embodiment, the engine or engine components may have surfaces comprising lead. The engine components may have a surface of steel or aluminum (typically a surface of steel).

An aluminum surface may be derived from an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment, the internal combustion engine may be a diesel fueled engine (typically a heavy duty diesel engine), a gasoline fueled engine, a natural gas-fueled engine or a mixed gasoline/alcohol fueled engine. In one embodiment, the internal combustion engine may be a diesel fueled engine and in another embodiment a gasoline fueled engine. In one embodiment, the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulfur, phosphorus or sulfated ash (ASTM D-874) content. The lubricating composition may be characterized as having at least one of (i) a sulfur content of 0.2 wt % to 0.4 wt % or less, (ii) a phosphorus content of 0.08 wt % to 0.15 wt %, and (iii) a sulfated ash content of 0.5 wt % to 1.5 wt % or less. The lubricating composition may also be characterized as having (i) a sulfur content of 0.5 wt % or less, (ii) a phosphorus content of 0.1 wt % or less, and (iii) a sulfated ash content of 0.5 wt % to 1.5 wt % or less. In yet another embodiment, the lubricating composition may be characterized as having a sulfated ash content of 0.5 wt % to 1.2 wt %.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the disclosed compositions, may not be susceptible of easy description. Nevertheless, all such modifications and reaction products are included within the scope of the present invention and the disclosed compositions encompass products formed by admixing the components and/or materials described above.

The following examples provide illustrations of the invention. These examples are non-exhaustive and are not intended to limit the scope of the invention.

EXAMPLES

Synthesis of Thiol-carboxylic Adducts

The following examples show the synthesis of various thiol-carboxylic adducts described herein.

Example A-1

Reaction Product of 1-dodecane Thiol and N,N-Dimethyl Acrylamide

For Example A-1, 1-dodecane thiol (1 mole ("mol.") equivalent ("eq.")), N, N-dimethylacrylamide (1 mol. eq.), octyl amine (0.5 mol. eq.) and 300 mL of a solvent mixture are added to a 4-necked, 1-L round bottom flask. The mixture is stirred vigorously to facilitate dissolution of the 1-dodecane thiol. The reaction is held at 75° C. until the reaction is complete. The reaction mixture comprising the thiol-carboxylic adduct (3-(ethylthio)-N,N-dimethylpropanamide) is obtained upon rotary evaporation and filtration over calcined diatomaceous earth.

Example A-2

Reaction Product of 1-Dodecane Thiol and Methyl Acrylate

For Example A-2, 1-dodecane thiol and methyl acrylate are reacted under the same reaction conditions as in Example A-1. A reaction mixture comprising methyl 3-(ethylthio)propanoate is obtained.

Example A-3

Reaction Product of 1-dodecane Thiol and 2-ethylhexyl Acrylate

For Example A-3, 1-dodecane thiol and 2-ethylhexyl acrylate are reacted under the same reaction conditions as in Example A-1. A reaction mixture comprising 2-ethylhexyl 3-(ethylthio)propanoate is obtained.

Example A-4

Reaction Product of 1-dodecane Thiol and Dodecyl Acrylate

For Example A-4, 1-dodecane thiol and dodecyl acrylate are reacted under the same reaction conditions as in Example A-1. A reaction mixture comprising dodecyl 3-(ethylthio)propanoate is obtained.

EXAMPLES

Performance of Thiol-Carboxylic Adducts

A series of 15W-40 engine lubricants in Group II base oil of lubricating viscosity are prepared containing the additives described above as well as conventional additives including a polymeric viscosity modifier, an ashless succinimide dispersant, overbased detergents, antioxidants (combination of phenolic ester, diarylamine, and sulfurized olefin), and zinc dialkyldithiophosphate (ZDDP), and other performance additives. All of the lubricants are prepared using the baseline lubricant composition as follows in Table 2.

TABLE 2

| Baseline Lubricant Composition1 | |
|---|---|
| | Baseline (BL) |
| Group II Base Oil | Balance to 100% |
| Calcium overbased detergent[2] | 1.73 |
| Zinc dialkyldithiophosphate | 1.09 |
| Antioxidant | 0.85 |
| Active Dispersant[3] | 4.76 |
| Viscosity Modifier | 0.56 |
| Additional additives[4] | 1.16 |
| % Phosphorus | 0.11 |

1All concentrations are on an oil free (i.e. active basis)

[2]Combination alkylsulfonate and sulfur-coupled alkylphenol

[3]2200 $M_n$ PIB succinimide dispersant (TBN~55)

[4]Additional additives include friction modifiers, foam inhibitors, surfactant, and soot dispersant viscosity modifier The thiol-carboxylic adducts described in Examples A-1 through A-4 were added to the baseline lubricant composition as in Table 3 below.

TABLE 3

| Lubricating Oil Composition Formulations | | | | |
|---|---|---|---|---|
| | A-1 | A-2 | A-3 | A-4 |
| BL | | | | |
| EX1 | 0.42 | | | |
| EX2 | | 0.40 | | |
| EX3 | | | 0.54 | |
| EX4 | | | | 0.61 |

The lubricants described above are evaluated in bench corrosion tests according to D6594 High Temperature Corrosion Bench Test (HTCBT) protocol except that the time was extended to 336 hrs. The amount of lead (Pb) in the oils at the end of test is measured and compared to the amount at the beginning of the test. Lower lead content in the oil indicates decreased lead corrosion. Overall the results obtained for each lubricant are shown in Table 3 below.

TABLE 3

| Corrosion Bench Test | |
|---|---|
| Example | Pb (ppm) |
| BL1 | 55 |
| EX1 | 36 |
| EX2 | 33 |
| EX3 | 14 |
| EX4 | 51 |

The lubricating oil compositions in Table 2 are evaluated using Pressure Differential Scanning calorimetry (PDSC). PDSC evaluates the oxidation resistance or stability of a lubricating oil by measuring the oxidation induction time (OIT). The OIT is the time between the start of the oil's exposure to oxygen and the onset of oxidation under isothermic conditions. Thus, the longer the OIT, the more resistant the oil is to oxidation. The PDSC data are obtained using the CEC L-85-99 test procedures for predicting lubricant performance in heavy duty diesel engines and are shown in Table 4 below.

TABLE 4

| PDSC Results | | |
|---|---|---|
| Example | L-85-99 OIT min | LZ PDSC OIT min |
| BL1 | 99.1 | 54.8 |
| EX1 | NA | 58.9 |
| EX2 | 99.3 | 56.9 |
| EX3 | 106.1 | 59.4 |
| EX4 | 117.3 | 60.4 |

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A lubricating composition comprising:

a. an oil of a lubricating viscosity;

b. 0.3 wt % to 3 wt % of a first antioxidant that is a thiol-carboxylic adduct that has the formula (II):

(II)

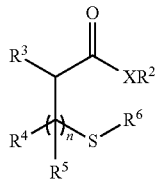

wherein $R^2$ is a hydrogen or a $C_1$-$C_{20}$ hydrocarbyl group; $R^3$, $R^4$, and $R^5$ individually are hydrogen or a $C_1$-$C_{12}$ hydrocarbyl group, $R^6$ is a $C_1$-$C_{20}$ hydrocarbyl group; X is O or N; and n is 0 or 1; and c. 0.5 to 3 wt % of an antiwear agent that is a zinc dialkyldithiophosphate.

2. The lubricating composition of claim 1, wherein said carboxylic acid and/or carboxylic acid derivative is an acrylic.

3. The lubricating composition of claim 2, wherein said acrylic comprises at least one (meth)acrylate, (meth)acrylic acid, (meth)acrylamide, or combinations thereof.

4. The lubricating composition of claim 2, wherein said acrylic is a (meth)acrylate having the formula (I):

(I)

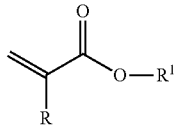

wherein R is a hydrogen or a $C_1$-$C_{20}$ hydrocarbyl group and $R^1$ is a $C_1$-$C_{20}$ hydrocarbyl group.

5. The lubricating composition of claim 4, wherein R is a hydrogen or a methyl group.

6. The lubricating composition of claim 4, wherein said (meth)acrylate comprises at least one acrylate, methacrylate, or combinations thereof.

7. The lubricating composition of claim 2, wherein said acrylic comprises at least one of octadecyl acrylate, hexadecyl acrylate, tridecyl acrylate, dodecyl acrylate, decyl acrylate, 2-propylheptyl acrylate, 2-ethylhexyl acrylate, octyl acrylate, hexyl acrylate, butyl acrylate, ethyl acrylate, methyl acrylate, or combinations thereof.

8. The lubricating composition of claim 2, wherein said acrylic comprises at least one of dimethylacrylamide, octadecyl methacrylate, hexadecyl methacrylate, tridecyl methacrylate, dodecyl methacrylate, decyl methacrylate, 2-propylheptyl methacrylate, 2-ethylhexyl methacrylate, octyl methacrylate, hexyl methacrylate, butyl methacrylate, ethyl methacrylate, methyl methacrylate, or combinations thereof.

9. The lubricating composition of claim 1, wherein said thiol comprises at least one of methanethiol, ethanethiol, 1-propanethiol, 2-propanethiol, butanethiol, tert-butyl mercaptan, pentanethiol, hexanethiol, octanethiol, decanethiol, 1-dodecanethiol, 2-dodecanethiol, hexadecanethiol, or combinations thereof.

10. The lubricating composition of claim 1, wherein said antiwear agent contains phosphorus and is present in an amount such that said lubricating composition has at least 300 ppm phosphorus based on a total weight of said lubricating composition.

11. The lubricating composition of claim 1, further comprising at least one nitrogen-containing dispersant.

12. The lubricating composition of claim 1, further comprising at least one boron-containing compound.

13. The lubricating composition of claim 12, wherein said boron-containing compound comprises at least one borate ester, borate alcohol, or combinations thereof.

14. The lubricating composition of claim 1, further comprising at least one overbased detergent.

15. The lubricating composition of claim 1, further comprising a second antioxidant.

16. The lubricating composition of claim 15, wherein the second antioxidant comprises at least one of a phenolic antioxidant, aminic antioxidant, or combinations thereof.

17. A method of lubricating an internal combustion engine comprising contacting said internal combustion engine with the lubricating composition of claim 1.

18. A method of reducing lubricant oxidation and/or corrosion in an internal combustion engine comprising contacting the internal combustion engine with the lubricating composition of claim 1.

19. The method of claim 18, wherein lead corrosion is reduced.

* * * * *